US005731120A

United States Patent [19]

Tanigami et al.

[11] Patent Number: 5,731,120

[45] Date of Patent: Mar. 24, 1998

[54] CARRIER FOR ELECTROPHOTOGRAPHY WITH SURFACE COATED WITH SPECIFIED CO-POLYMER RESIN OF ORGANOPOLYSILOXANE WITH RADICAL MONOMER

[75] Inventors: Yukio Tanigami, Amagasaki; Ichiro Demizu, Toyonaka; Mitsutoshi Nakamura, Ibaraki; Yasuki Nagai, Amagasaki; Osamu Maeda, Sanda, all of Japan

[73] Assignee: Minolta Co., Ltd., Osaka, Japan

[21] Appl. No.: 564,824

[22] Filed: Nov. 29, 1995

[30] Foreign Application Priority Data

| | | | |
|---|---|---|---|
| Nov. 30, 1994 | [JP] | Japan | 6-296350 |
| Dec. 27, 1994 | [JP] | Japan | 6-325218 |
| Mar. 7, 1995 | [JP] | Japan | 7-047358 |
| Jul. 19, 1995 | [JP] | Japan | 7-182682 |

[51] Int. Cl.[6] ..... G03G 9/00

[52] U.S. Cl. ..... 430/106.6; 430/108; 428/423.1

[58] Field of Search ..... 430/106.6, 108, 430/423.1

[56] References Cited

U.S. PATENT DOCUMENTS

| | | | |
|---|---|---|---|
| 3,526,533 | 9/1970 | Jacknow et al. . | |
| 4,342,824 | 8/1982 | Campbell . | |
| 4,514,485 | 4/1985 | Ushiyama et al. . | |
| 4,672,016 | 6/1987 | Isoda et al. . | |
| 5,079,124 | 1/1992 | Kawata et al. . | |
| 5,085,964 | 2/1992 | Kawata et al. . | |
| 5,256,511 | 10/1993 | Matsumura et al. . | |
| 5,258,253 | 11/1993 | Fukumoto et al. . | |
| 5,397,668 | 3/1995 | Sato et al. | 430/108 |
| 5,432,534 | 7/1995 | Maruyama et al. | 347/172 |

FOREIGN PATENT DOCUMENTS

| | | |
|---|---|---|
| 54-21730 | 2/1979 | Japan . |
| 55-157751 | 12/1980 | Japan . |
| 59-131944 | 7/1984 | Japan . |
| 60-202450 | 10/1985 | Japan . |
| 62-261321 | 6/1987 | Japan . |
| 5-224466 | 9/1993 | Japan . |

OTHER PUBLICATIONS

Chemical Abstracts 125 :35538, Mar. 1996.

*Primary Examiner*—Christopher D. Rodee
*Attorney, Agent, or Firm*—McDermott, Will & Emery

[57] ABSTRACT

The present invention provides a carrier comprising:

a magnetic core; and a specified coating layer formed onto the surface of the core, said layer comprising a copolymer of a specified organopolysiloxysane with a radical monomer, which may be cured by a curing agent, being excellent in resistance to spent phenomenon, environmental resistance and durability.

29 Claims, No Drawings

CARRIER FOR ELECTROPHOTOGRAPHY WITH SURFACE COATED WITH SPECIFIED CO-POLYMER RESIN OF ORGANOPOLYSILOXANE WITH RADICAL MONOMER

BACKGROUND OF THE INVENTION

1. Field of the Invention

The present invention relates to carrier particles for electrophotography, the surfaces of which are coated with a specific resin.

2. Description of the Prior Art

A two-component developing system is popular in the field of electrophotography. In the two-component developing system, carrier particles are mixed and stirred with toner particles. The both particles are charged triboelectricly. Electrostatic latent images formed on a photosensitive member etc. are developed by the charged toner particles.

As the carrier particles are mixed and stirred with the toner particles, a resin component contained in the toner adheres to the surface of carrier particles by the physical force generated in the stirring process (referred to as "toner-spent phenomenon" hereinafter).

When the toner-spent phenomenon appears, initial performances with respect to tribo-charging ability of the carrier particles can not be kept, resulting in deterioration of image-quality. This problem becomes serious when a toner for full color containing a resin having a low melting point is charged tribo-electrically.

Some resin has been coated on the surface of core particles of carrier in order to prevent the toner-spent phenomenon. Especially, silicone resin and fluorine have been paid attention to from the viewpoint of the prevention of toner-spent phenomenon because of low surface energy and excellent releasing properties.

However, although silicone resin is excellent in releasing properties, its adhesivity to the core particles is poor. Therefore, the coating resin begins to separate out from the core particles when used for a long time, resulting in poor durability.

Fluorine resin, as well as silicone resin, is excellent in releasing properties. Fluorine resin, however, has so strong negatively-charged properties that the charging properties depend much on environments.

SUMMARY OF THE INVENTION

The object of the present invention is to provide carrier particles having no problems as above mentioned.

Another object of the present invention is to provide carrier particles having no problem with respect to toner-spent phenomenon.

Another object of the present invention is to provide carrier particles excellent in durability.

Another object of the present invention is to provide carrier particles having charging properties independent of environment.

Another object of the present invention is to provide carrier particles having no problem with respect to toner-spent phenomenon, even when used in the combination of toner for full-color.

Another object of the present invention is to provide carrier particles excellent in resistance to toner spent phenomenon, durability and environmental resistance.

The present invention relates to a carrier comprising:

a magnetic core; and a specified coating layer formed on the surface of the core, said layer comprising a copolymer of a specified organopolysiloxane with a radical monomer.

DETAILED DESCRIPTION OF THE INVENTION

One preferred embodiment of the invention relates to a carrier for electrophotography, the surface of which is coated with a specific thermosetting resin. The thermosetting resin is prepared by copolymerizing a specified organopolysiloxane having a vinyl group at the end with a radical-copolymerizable monomer having at least one functional group selected from the group consisting of a hydroxy group, an amino group, an amide group and an imide group, followed by crosslinking the resultant copolymer with isocyanates.

The organopolysiloxane having vinyl group at the end is exemplified by the compounds represented by the following formulas (AI)–(AIV).

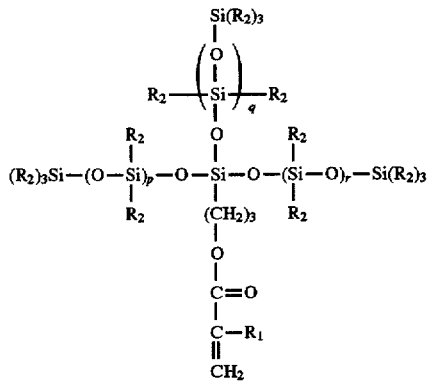

(AI)

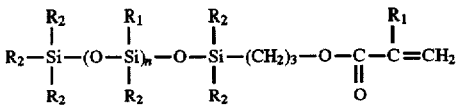

(AII)

-continued

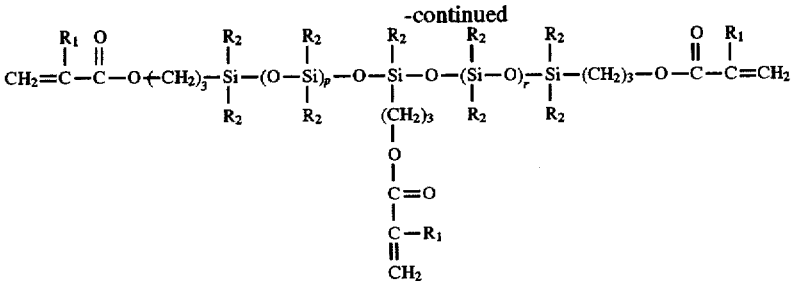

(AIII)

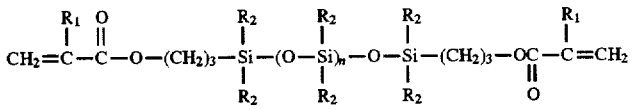

(AIV)

In the chemical formulas (AI)–(AIV), $R_1$ represents a hydrogen atom or a methyl group, preferably a methyl group. $R_2$ represents a C1–C3 alkyl group or a phenyl group, preferably a methyl group from the viewpoint of easiness of production and economic aspect.

The "n" in the formula (AII) and (AIV) represents an integer, preferably 2-500, more preferably 2-64.

The "p", "q"and "r" in the formula (AI) and (AIII) represent $p \geqq 0$ $q \geqq 0$ and $r \geqq 0$ respectively, preferably $0 \leqq p+q+r \leqq 500$, more preferably $0 \leqq p+q+r \leqq 64$.

The compounds represented by the chemical formula (AI)–(AIV) are available in the market. For example, the compounds of the formula (AI) are available as TM0701 (made by Tisso K. K.), X-22-5002 (made by Shinetsu Kagaku Kogyo K. K.), and X-22-5004C (made by Shinetsu Kagaku Kogyo K. K.), the compound of the formula (AII) are available as FM0711 (made by Tisso K. K.), and the compound of the formula (AIV) are available as X-22-164B (made by Shinetsu Kagaku Kogyo K. K.) and X-22-164C (made by Shinetsu Kagaku Kogyo K. K.).

Preferred organopolysiloxane is the one represented by the chemical formulas (AI) and (AII) having one vinyl group. In particular, the compound of the formula (AI) in which both $R_1$ and $R_2$ are methyl groups and $p+q+r=0$, and the compound of the formula (AII) in which both $R_1$ and $R_2$ are methyl groups and n is 10, are preferable.

It should be noticed in the formulas (AI)–(AIV), that, for example, when $R_1$ of the formula (AI) is a methyl group, the $R_1$ in the other formulas (AII)–(AIV) does not necessarily represent a methyl group. When $R_1$ in the formula (AI) is a methyl group, $R_1$ in the formula (AII) may be a hydrogen atom. That is to say, the compounds of the chemical formulas of (AI)–(AIV) are described independently from each other. The other symbols 'n', 'p' and 'q' are described similarly to $R_1$.

The organopolysiloxane has a structure having a vinyl group at the end. The vinyl group reacts with a radical copolymerizable monomer.

The organopolysiloxane is copolymerized with a radical co-po lymerizable monomer having at least one functional group selected from the group consisting of a hydroxy group, an amino group, an amide group and an imide group.

The copolymerizable monomer having a hydroxy group may be exemplified by acrylates, such as β-hydroxypropyl acrylate and β-hydroxyethyl acrylate, and methacrylates, such as 2-hydroxyethyl methacrylate.

The copolymerizable monomer having an amino group may be exemplified by an amino group-containing vinyl monomer, such as dimethylaminoethyl methacrylate, diethylaminoethyl methacrylate, dimethylaminoethyl acrylate and dimethylaminopropyl methacrylamide.

The copolymerizable monomer having an amide group may be exemplified by acrylamide, methacrylamide, α-ethylacrylamide, maleic diamide and fumaric diamide.

The copolymerizable monomer having an imide group may be exemplified by ma leimide monomers, such as N-lauryl maleimide, N-phenyl maleimide, N-cyclohexcyl maleimide.

The hydroxyl group, amino group and imide group contained in the copolymerizable monomers works for cross-linking with isocyanate cross-linking agents. In the present invention, it is preferable to use monomers having a hydroxy group.

Other radical co-polymerizable monomer (referred to merely as "radical monomer" hereinafter) may be further added other than the radical copolymerizable monomer having at least one functional group selected from the group consisting of a hydroxy group, an amino group, an amide group and an imide group (referred to as "radical cross-linking monomer" hereinafter). The addition of the copolymerizable monomer effects to improve adhesivity to carrier cores and adjust to chargeability. The copolymerizable monomer used in such an addition may be exemplified by an acrylate monomer, such as methyl acrylate, ethyl acrylate and butyl acrylate, a methacrylate monomer, such as methyl methacrylate, ethyl methacrylate, butyl methacrylate and glycidyl methacrylate, an acrylic monomers, such as acrylonitrile, a styrene monomer, such as styrene, α-methylstyrene, vinyltoluene and p-ethylstyrene, a vinyl monomer, such as ethylene, propylene and vinylacetate, and a mixture thereof.

The organopolysiloxane is treated with the radical crosslinking monomer, and the desired radical monomer to form a radical copolymer.

In the radical copolymerizable process, the organopolysiloxane is contained at an amount of 5–8% by weight, preferably 10–70% by weight, more preferably 30–60% by weight on the basis of a total amount of monomers. If the content of organopolysi loxane is less than 5% by weight, the effects caused by organopolysiloxane, such as toner-spent resistance are deminished and environmental resistance. If the content is 80% by weight, wearing resistance is lowered.

The radical polymerization method may adopt a conventional suspension polymerization method, such as emulsion polymerization, solution polymerization etc. From the viewpoint of productivity, the solution polymerization method is preferred. A conventional solvent and polymer initiator may be used in the solution polymerization method.

The obtained copolymer is dissolved in an adequate solvent, such as methyl ethyl ketone together with a crosslinking agent. The resultant solution is coated on carrier cores.

The preferred corsslinking agent is an isocyanate compound. This type of crosslinking agent is particularly suitable for a negatively chargeable toner.

The isocyanate compounds are exemplified by hexamethylene diisocyanate(HMDI), isophorone diisocyanate(IDPI), tolylene diisocyanate(TDI), diphenylmethane diisocyanate (MDI), xylylene diisocyanate(XDI), and isocyanates represented by the following chemical formulas (AV)–(AIX) having 3–6 functional groups;

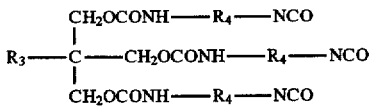

(AV)

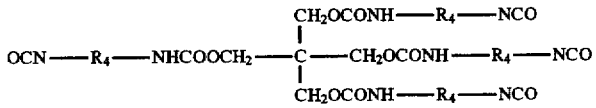

(AVI)

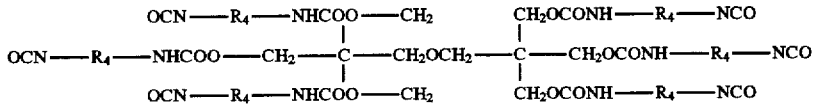

(AVII)

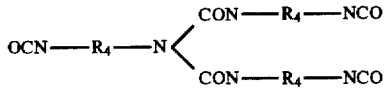

(AVIII)

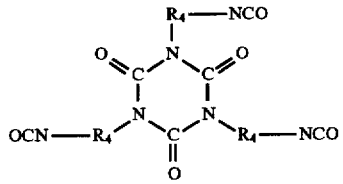

(AIX)

In the formulas (AV)–(AIX), $R_3$ is selected from a hydrogen atom, a methyl group and an ethyl group. $R_4$ is selected from $-(CH_2)_6-$,

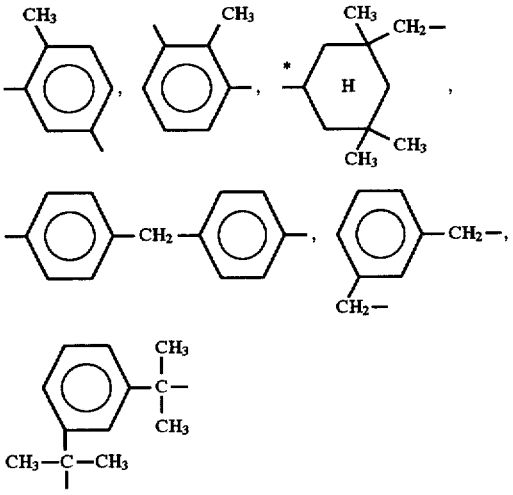

It should be noticed that $R_4$ may be identical or different in the each formula.

The isocyanate compound is mixed with the copolymer in such a way that a molar ratio of a functional group, such as hydroxy group, of the radical cross-linking monomer in the copolymer to NCO in the isocyanate compound is 0.1–20, preferably 0.5–2, more preferably about 1. The ratio of higher than 20 may not achieve sufficient crosslinking. The ratio of less than 0.1 may influence adversely on chargeability.

The isocyanate compounds may have isocyanates masked partially or fully with phenol, amide, alcohol, amine etc.

When the organopolysiloxane represented by the following formula (BX);

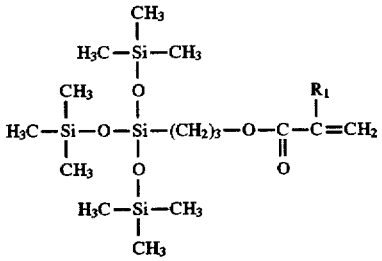

(BX)

in which $R_1$ is a hydrogen atom or a methyl group, may be copolymerized with a radical polymerizable monomer without use of the crosslinking agent to give a coating layer for carrier.

As the organopolysiloxane of the formula (BX) has a vinyl group at the end, the organopolysiloxane can be co-polymerized with other radical polymerizable monomer to form graft polymer. When the obtained copolymer is coated on carrier cores, silicone components would exist abundantly on the outersurface of the carrier. The portion of monomer having affinity with carrier would exist on the carrier side. Therefore, The coating layer is excellent in its adhesivity to carrier and may give the surface of carrier excellent releasing properties. Thereby, the coated carrier may be made excellent in resistance to spent phenomenon, environmental resistance and durability.

One of characteristics of the carrier of the present invention is excellent in fluidity caused by relatively short main chain of the organopolysiloxane.

The radical polymerizable monomer to be copolymerized with the organopolysiloxane is not limited insofar as the monomer has affinity with a core material of carrier and can be co-polymerized with the organopolysiloxane. Such a monomer may be exemplified by acrylate monomers, such as methyl acry late, ethyl acrylate, butyl acrylate, β-hydroxypropyl acrylate and β-hydroxyethyl acrylate, methacrylate monomers, such as methyl methacrylate, ethyl methacrylate, butyl methacrylate, 2-hydroxyethyl methacrylate and glycidyl methacrylate, acrylic derivatives, such as acrylonitrile and methacrylonitrile, amino group-containing vinyl monomers, such as dimethylaminoethyl methacrylate, diethy laminoethyl methacrylate, dimethylaminoethyl acrylate and dimethylaminopropyl methacrylamide, vinyl monomers, such as styrene, α-methylstyrene, vinyltoluene, p-ethylstyrene, vinyl acetate, vinyl chloride, ethylene and propylene, maleimide monomers, such as N-lauryl maleimide, N-phenyl maleimide and N-cyclohexcyl maleimide, and amide-group-containing monomers, such as acrylamide, methacrylamide, αethylacrylamide, maleic diamide and fumaric diamide.

Preferred monomers are methyl acrylate, ethyl acrylate, methyl methacrylate and ethyl methacrylate.

Those radical co-polymerizable monomers may be used singly or in combination.

The organopolysiloxane represented by the formula (BX) is used at an amount of 5–80% by weight, preferably 20–60% by weight on the basis of a total amount of both the radical co-polymerizable monomer and the organopolysiloxane. If the amount is less than 5% by weight, the effects achieved by the siloxane, such as releasing properties and environmental resistance. If the amount is more than 80% by weight, the adhesivity of the coating layer to magnetic particles is lowered.

The radical polymerization method may adopt a conventional suspension polymerization method, such as emulsion polymerization method, solution polymerization method, mass polymerization etc. in order to coat carrier particles by polymerizing the organopo lysiloxane represented by the formula (BX) with the copolymerizable monomer. From the viewpoint of productivity, the solution polymerization method is preferred. A conventional solvent and polymer initiator may be used in the solution polymerization method.

The carrier cores, which are coated with the copolymer, have a mean particle size of at least 20 μm from the viewpoint of prevention of carrier adhesion (scattering) to a supporting member of electrostatic latent images, and at most 100 μm from the viewpoint of prevention of deterioration of image-quality caused by carrier lines.

The carrier cores are exemplified by metals, such as ferrite, magnetite, iron, nickel and cobalt, alloy or mixture thereof with zinc, antimony, aluminum, lead, tin, bismuth, beryllium, manganese, selenium, tungsten, zirconium and vanadium, a mixture thereof with metal oxides, such as iron oxide, titanium oxide and magnesium oxide, nitrides, such as chromium nitride and vanadium nitride, carbides, such as silicone carbide and tungsten carbide, ferromagnetic ferrite, and any other conventional cores for a two-component carrier for electrophotography, and a mixture thereof.

A coating amount of the resin is 0.3–5% by weight, preferably 0.5–3% by weight relative to the core. If the amount is less than 0.3% by weight, it is impossible to coat the core uniformly, resulting in deterioration of environmental resistance. If the amount is larger than 5% by weight, the coating effect can not be obtained in proportion to the coating amount. Further, such a large coating amount is not preferable from the viewpoint of saving of resources and economic loss. Further, the essential function of carrier is weakened.

When the crosslinking agent, such as isocyanate etc. is not used to coat the carrier, the obtained copolymer is dissolved in an adequate solvent, such as methyl ethyl ketone, methyl isobutyl ketone and dioxane, and the resultant solution is applied by a spray drying method, tumble-fluidizing method so that the above coating amount may be coated on the carrier. The carrier core may be dipped in a resin solution for coating, followed by drying.

When the crosslinking agent, such as isocyanate etc. is used to coat the carrier, any coating method may be applied. For example, a dipping method in which core particles are dipped in a solution of copolymer and isocyanate, tumble-fluidizing method in which the solution is sprayed and spray-drying method may be applied.

When the curing agent is used, the carrier cores coated with the resin is cured by heat under high temperature conditions. The curing conditions may depend on the copolymer and cross-linking agent. Generally, the carrier cores are treated for 2–5 hours at 140–240° C., preferably 150–230° C.

The coating layer of carrier of the present invention may contain electroconductive particles, which may not be limitative insofar as the particles have an electrical resistance within the range between $10^3$–$10^9$ Ω cm and may be exemplified by fine particles of metal oxides, such as tin oxide and titanium dioxide, titanium dioxide the surface of which is treated with tin oxide and/or antimony oxide, magnetic fine particles, such as magnetite and ferrite, and carbon black. A mean particle size of the fine particles is 0.01–2.0 μm. An addition amount is 0.01–10% by weight relative to the core particles. The addition of the electroconductive fine particles to the coating layer effects to improve electrification-build-up properties.

The addition of the electroconductive fine particles to the coating layer may be achieved by the following; the method in which the fine particles are added to a resin solution for coating and then the obtained solution is applied to carrier cores, and the method in which a resin-coated carrier is mixed with the fine particles, the particles are adhered electrostatically to the carrier and then a mechanical impact is applied to the carrier to fix the fine particles on the surface.

In the present invention, the surface of the magnetic particles (carrier cores) with or without the coating layer may be treated with at least one surface treating agent selected from the group consisting of silane coupling agents, titanate coupling agents, aluminum coupling agents and zirconium-aluminum coupling agents. Such a surface treatment effects to impart excellent environmental properties to the carrier. The surface treatment prior to resin-coating may contribute to improvement of adhesivity of the coating layer to carrier cores.

The silane coupling agents may be exemplified by chlorosilanes, alkyl silanes, alkoxy silanes and silazanes, more concretely by:

$CH_3SiCl_3$ $(CH_3)_2SiCl_2$ $(CH_3)_3SiCl$ $CH_3Si(OCH_3)_3$ $CH_3Si(OCH_2CH_3)_3$ $(CH_3)_3Si(OCH_3)$ $(CH_3)_2Si(OCH_3)_2$ $(CH_3)_2Si(OCH_2CH_3)_2$
$Si(OCH_2CH_3)_4$
$Si(OCH_3)_4$
$CH_3(H)Si(OCH_3)_2$
$CH_3(H)Si(OCH_2CH_3)_2$
$(CH_3)_2(H)Si(OCH_2CH_3)$

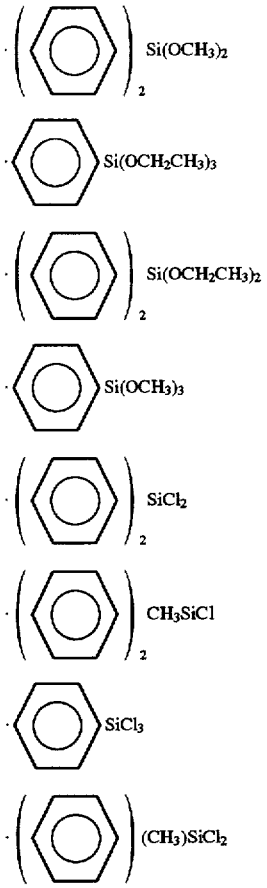

$(CH_3)_3SiNHSi(CH_3)_3$
$CH_3(CH_2)_{17}Si(CH_3)(OCH_3)_2$
$CH_3(CH_2)_{17}Si(OCH_3)_3$
$CH_3(CH_2)_{17}Si(OC_2H_5)_3$
$CH_3(CH_2)_3Si(CH_3)_2Cl$
$CH_3(CH_2)_{17}Si(CH_3)_2Cl$
$CH_3(CH_2)_{17}Si(CH_3)Cl_2$
$CH_3(CH_2)_{17}SiCl_3$

The titanate coupling agents may be exemplified by the compounds represented by the following chemical formulas:

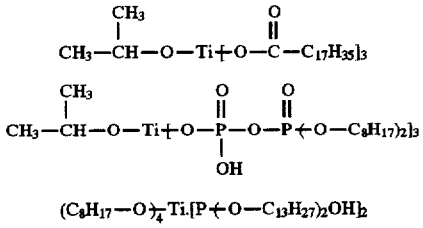

-continued

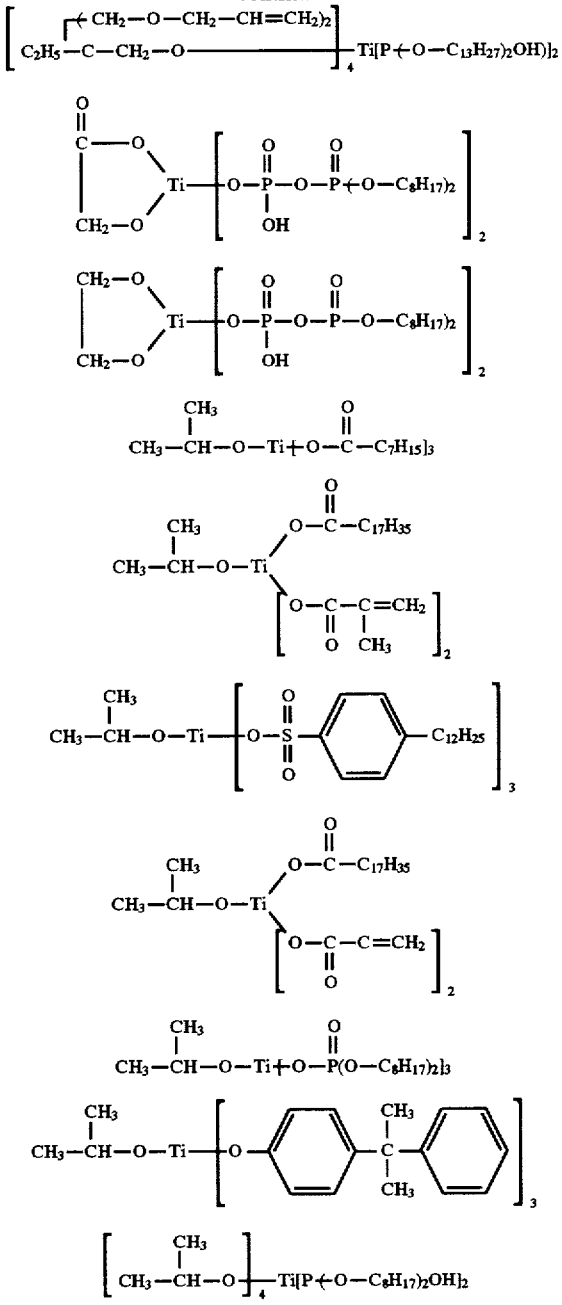

The aluminum coupling agents may be exemplified by the compounds represented by the following formula:

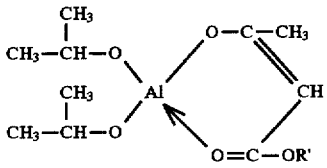

in which R' represents a lower alkyl group, such as a methyl group, an ethyl group, an i-propyl group, a propyl group, n-butyl group, and a t-butyl group.

The zirconium-aluminum coupling agents may be exemplified by the compounds represented by the following formula:

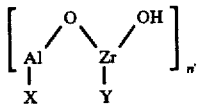

in which X and Y may be identical or different, and represent respectively an amino group, a carboxyl group, a mercapt group and a higher alkyl group containing a carboxyl group, and n' represents an integer of more than 1.

The compounds available in the market may be exemplified by CAVCO MOD A, CAVCO ME)DO C, CAVCO MOD S, CAVCO MODO MPG, CAVCO MODO C-1, CAVCO MODO F, CAVCO MODO M, CAVCO MODO M-1, CAVCO MODO APG, CAVCO MODO CPG, CAVCO MODO CPM, AND CAVCO MOD MPG (all are made by CAVEDON CHEMICAL K. K.)

The surface of magnetic particles or carrier particles is treated by the above coupling agent as follows. First of all, the coupling agent is mixed and diluted with an adequate solvent, such as tetrahydrfuran, methyl alcohol, isopropyl alcohol, toluene, ethyl acetate, methyl ethyl ketone and acetone. While the inorganic particles are stirred obligatorily by, for example, a blender, the diluted solution of the coupling agent is dropped or sprayed and the mixture are sufficiently stirred. The resultant mixture is put in a receptacle and dried by heat in an oven. Then, the dried bulk is stirred to be broken sufficiently by the blender. In this method, each coupling agent may be added separately or in combination at the same time. In addition to the above dry process, the following wet process may be adopted; magnetic particles are dipped in an organic solution containing the coupling agent, followed by heating, drying and pulverization.

In addition to the coupling agent effective for environmental resistance, a coupling agent having a polar group chargeable positively or negatively may be added. The addition of such a coupling agent effects to adjust the chargeability of carrier. The carrier treated by the polar group chargeable negatively works effectively to charge toner positively. The carrier treated by the polar group chargeable positively works effectively to charge toner negatively.

The coupling agent having the polar group chargeable negatively may be exemplified by fluorine silane coupling agents, such as $CF_3(CH_2)_2SiCl_3$
$CF_3(CF_2)_5SiCl_3$
$CF_3(CF_2)_5(CH_2)_2SiCl_3$
$CF_3(CF_2)_7(CH_2)_2SiCl_3$
$CF_3(CF_2)_7CH_2CH_2Si(OCH_3)_3$
$CF_3(CF_2)_7(CH_2)_2Si(CH_3)Cl_3$
$CF_3(CH_2)_2Si(OCH_3)_3$
$CF_3(CH_2)_2Si(CH_3)(OCH_3)_2$
$CF_3(CF_2)_3(CH_2)_2Si(OCH_3)_3$
$CF_3(CF_2)_5(CH_2)_2Si(OCH_3)_3$
$CF_3(CF_2)_6CONH(CH_2)_2Si(OC_2H_5)_3$
$CF_3(CF_2)_6COO(CH_2)_2Si(OCH_3)_3$
$CF_3(CF_2)_7(CH_2)_2Si(OCH_3)_3$
$CF_3(CF_2)_7(CH_2)_2Si(CH_3)(OCH_3)_2$
$CF_3(CF_2)_7SO_2NH(CH_2)_3Si(OC_2H_5)_3$
$CF_3(CF_2)_8(CH_2)_2Si(OCH_3)_3$ The coupling agent having the polar group chargeable positively may be exemplified by amine coupling agents, such as $H_2N(CH_2)_2NH(CH_2)_3Si(OCH_3)_3$
$H_2N(CH_2)_2NH(CH_2)_3Si(CH_3)(OCH_3)_2$
$H_2N(CH_2)_2NH(CH_2)_3Si(OCH_3)_3$
$H_2N(CH_2)_2NH(CH_2)_2NH(CH_2)_3Si(OCH_3)_3$
$H_2N(CH_2)_3Si(OCH_3)_3$
$C_6H_5NH(CH_2)_3Si(OCH_3)_3$

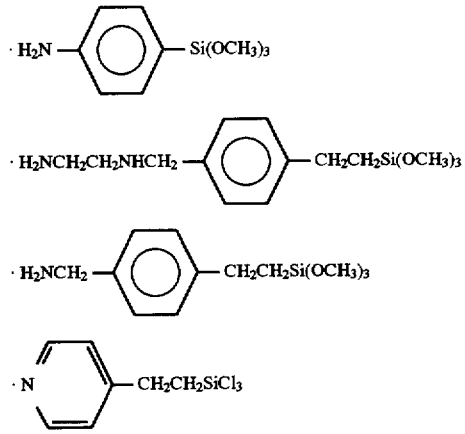

The above coupling agent may be used singly or in combination.

The obtained coating layer is excellent in strength, resistance to impact and adhesivity of the layer to the cores. The resultant carrier is excellent in environmental resistance and durability and can form excellent images over an extended period of time.

The carrier of the present invention may be applied to any conventional toner for a tow-component developer. In particular, the carrier of the present invention is effective for a toner for full color that contains a lot of post-treatment agent, such as hydrophobic silica.

The present invention is further explained hereinafter by concrete examples. First of all, Examples of Synthesis of resin are shown. The monomers, polymerization initiators and polymerization solvents, which are used in Synthesis Examples are shown by the following abbreviations. "Part (s)" means part(s) by weight if not particularly specified.

MA: methyl methacrylate,

HEMA: 2-hydroxyethyl methacrylate,

MPTS (organopolysiloxane-1): 3-methacryloxy-propyl-tris (trimethylsiloxy)silane (in the formula (I), R1=methyl, R2=methyl, p=q=r=0), V-40: 1,1'-azobis(cyclohexane-1 -carbonitrile), MEK: metyl ethyl ketone, Organopolysiloxane-2 (in the formula (AI), $R_1$ =methyl R2=methyl, p=q=r=3).

Organopolysiloxane-3 (in the formula (AII), R1=methyl R2=methyl, n=10).

Examples using cross-linking agents are explained hereinafter.

SYNTHESIS EXAMPLE A1 OF RESIN

MEK of 100 parts was put in a 500-ml flask equipped with a stirrer, a condenser, a thermometer, a nitrogen-inlet pipe, a dropping funnel. MEK in the flask was kept at 80° C.

Separately, 32.6 parts of MA, 2.5 parts of HEMA, 64.9 parts of MPTS, 1 part of V-40 are dissolved in 100 parts of MEK. The resultant solution was dropped into the flask kept at 80° C. for 2 hours to be matured for 5 hours.

SYNTHESIS EXAMPLES A2–A7 OF RESIN

Synthesis was carried out in a manner similar to Synthesis Example A1 of Resin, except that MA, HEMA and MPTS (organopolysiloxane-1) were used at an amount shown in Table 1 below:

TABLE 1

| Symthesis Example | MMA (parts) | HEMA (parts) | Organopolysiloxane-1 (parts) |
|---|---|---|---|
| A1 | 32.6 | 2.5 | 64.9 |
| A2 | 25.1 | 5.1 | 69.8 |
| A3 | 43.4 | 2.5 | 54.1 |
| A4 | 36.7 | 5.1 | 58.2 |
| A5 | 48.4 | 5.1 | 46.5 |
| A6 | 60.0 | 5.1 | 34.9 |
| A7 | 50.0 | 0 | 50.0 |

SYNTHESIS EXAMPLE A8 OF RESIN

Synthesis was carried out in a manner similar to Synthesis Example A4 of Resin, except that Organopolysiloxane-2 was used instead of Organopolysiloxane-1.

SYNTHESIS EXAMPLE A9 OF RESIN

Synthesis was carried out in a manner similar to Synthesis Example A4 of Resin, except that Organopolysiloxane-3 was used instead of Organopolysiloxane-1.

TONER PRODUCTION EXAMPLE A1

Alcohol components of bisphenol A propylene oxide (PO) and bisphenol A ethylene oxide (EO) were condensed with acids of fumal acid (FA) and terephthalic acid (TPA) at a ratio of (PO):(EO):(FA):(TPA)=5:5:5:4 to give linear polyester resin having no component insoluble in tetrahydrofuran. The polyester resin had an acid value of 3.1 mgKOH/g, OH value of 31.7 mgKOH/g, number average molecular weight (Mn) of 6,500, weight average molecular weight (Mw) of 15,000, Mw/Mn of 2.3, glass transition point of 58.4° C., softening point of 95.2° C., apparent melt viscosity at 90° C. of $4.0\times10^5$ poise. The polyester of 100 parts was mixed sufficiently with PERMANENT RUBIN F6B (made by Hext K. K.) of 3 parts, zinc complex of salicylic acid derivative (E-84, made by Oriento Kagaku Kogyo K. K.) as a charge controlling agent in Henshel mixer.

The mixture was kneaded in a two-axial extruder and cooled. The kneaded material was roughly pulverized by a feather mill and finely pulverized by a jet mill.

The finely pulverized materials were classified to give toner particles having volume average particle size of 7.9 μm and number average particle size of 6.9 μm.

The toner particles of 100 parts were mixed with silica fine particles (H1303, made by Hext K. K.) of 0.4 parts and titanium oxide fine particles (400BS, made by Teika K.K.) of 0.7 parts in Henshel mixer to give magenta toner (Toner A).

TONER PRODUCTION EXAMPLE A2

Black toner (Toner B) was prepared in a manner similar to Toner Production Example A1, except that carbon black MA#8 (made by Mitsubishi Kasei K. K.) of 3 parts was used as a colorant and Bontron F-21 (made by Oriento Kagaku Kogyo K. K.) was used as a charge controlling agent.

EXAMPLE A1

The resin prepared in Synthesis Example A1 of Resin was mixed with isophorone-diisocyanate/trimethylol-propane adduct (IPDI/TMP:NCO%=6.1%) as a cross-linking agent in such a way that the molar ratio of OH/NCO (OH is the one in the resin prepared in Synthesis Example A1) was 1/1. The mixture was diluted with MEK to give a resin solution for coating having a solid ratio of 3% by weight.

A sintered ferrite powder F-300 (average particle size of 50 μm, bulk density of 2.53 g/cm$^3$, made by Powder Tech K. K.) was used as a core. The solution for coating was applied to the core by Spira-Coater (made by Okada Seiko K. K.) in such a way that the coating resin was applied to the core at 1.5% by weight relative to the core weight, followed by drying.

The resultant carrier was sintered for one hour at 160° C. in hot-air circulating oven. After cooling, the resultant ferrite bulk was pulverized by a screening apparatus equipped with a screen mesh having an opening between 106 μm and 75 μm. Thus, Resin-Coated Carrier (A1) was obtained.

EXAMPLES A2–A8

Resin-Coated Carriers (A2)–(A8) were prepared in a manner similar to Example A1, except that resins prepared in Synthesis Examples, core materials, resin-coating materials were used as shown in the following Table 2. The same cross-linking agent as in Examle A1 was used.

TABLE 2

| | | Core | | | | |
|---|---|---|---|---|---|---|
| Example | Resin prepared in Synthesis Example | Made by | Material | Volume Average Particle Size (μm) | Bulk density (g/cm$^3$) | Coating Resin Amount (wt. %) |
| A1 | Synthesis Example A1 | F-300 (Powder Tech K.K.) | Ferrite | 50 | 2.53 | 1.5 |
| A2 | Synthesis Example A2 | F-400 (Powder Tech K.K.) | Ferrite | 40 | 2.48 | 2.0 |
| A3 | Synthesis Example A3 | F-300 (Powder Tech K.K.) | Ferrite | 50 | 2.69 | 1.0 |
| A4 | Synthesis Example A4 | F-300 (Powder Tech K.K.) | Ferrite | 50 | 2.53 | 1.5 |
| A5 | Synthesis Example A5 | KM-40 (Kanto Denka K.K.) | Magnetite | 40 | 2.37 | 1.5 |
| A6 | Synthesis Example A6 | KM-40 (Kanto Denka K.K.) | Magnetite | 40 | 2.37 | 1.5 |
| A7 | Synthesis Example | F-300 (Powder | Ferrite | 50 | 2.53 | 1.5 |

TABLE 2-continued

| Example | Resin prepared in Synthesis Example | Core: Made by | Core: Material | Core: Volume Average Particle Size (μm) | Core: Bulk density (g/cm³) | Coating Resin Amount (wt. %) |
|---|---|---|---|---|---|---|
| A8 | A8 Synthesis Example A9 | Tech K.K.) F-300 (Powder Tech K.K.) | Ferrite | 50 | 2.53 | 1.5 |

EXAMPLE A9

The resin prepared in Synthesis Example A1 of Resin was mixed with isophorone-diisocyanate/trimethylol-propane adduct (IPDI/TMP:NCO%=6.1%) as a cross-linking agent in such a way that the molar ratio of OH/NCO (OH is the one in the resin prepared in Synthesis Example A1) was 1/1. The mixture was diluted with MEK to give a resin solution for coating having a solid ratio of 3% by weight.

Methyltrimethoxysilane (1 g) was dissolved in a solvent-mixture of toluene (450 ml) and methanol (50 ml) to give a silane-containing solution A sintered ferrite powder F-300 (average particle size of 50 μm, bulk density of 2.53 g/cm³, made by Powder Tech K. K.) as a core was treated with the silane-containing solution by means of multi-purpose stirrer (made by Dalton K. K.). Thus, the ferrite core treated with silane-coupling agent was prepared.

The solution for coating was applied to the silane-coupling-agent treated core by Spira-Coater in such a way that the coating resin was applied to the core at 1.5% by weight relative to the core weight, followed by drying.

The resultant carrier was sintered for one hour at 160° C. in hot-air circulating oven. After cooling, the resultant ferrite bulk was pulverized by a screening apparatus equipped with a screen mesh having an opening between 106 μm and 75 μm. Thus, Resin-Coated Carrier (A9) was obtained.

EXAMPLE A10

The resin prepared in Synthesis Example A1 of Resin was mixed with isophorone-diisocyanate/trimethylol-propane adduct (IPDI/TMP:NCO%=6.1%) as a cross-linking agent in such a way that the molar ratio of OH/NCO (OH is the one in the resin prepared in Synthesis Example A1) was 1/1. The mixture was diluted with MEK to give a resin solution for coating having a solid ratio of 3% by weight.

A sintered ferrite powder F-300 (average particle size of 50 μm, bulk density of 2.53 g/cm³, made by Powder Tech K. K.) was used as a core. The solution for coating was applied to the core by Spira-Coater (made by Okada Seiko K. K.) in such a way that the coating resin was applied to the core at 1.5% by weight relative to the core weight, followed by drying.

Tetraethoxysilane (2 g) was dissolved in a solvent-mixture of toluene (450 ml) and methanol (50 ml) to give a silane-containing solution.

The above obtained carrier was treated with the silane-containing solution by means of a multi-purpose stirrer (made by Dalton K. K.). Thus, the ferrite core treated with silane-coupling agent was prepared.

The obtained carrier was sintered for one hour at 160° C. in hot-air circulating oven. After cooling, the obtained ferrite bulk was pulverized by a screening apparatus equipped with a screen mesh having an opening between 106 μm and 75 μm. Thus, Resin-Coated Carrier (10) was obtained.

EXAMPLE A11

Ferrite fine particles (MFP-2; made by TDK K. K.) were added to the resin solution for coating prepared in Example A1 at an amount of 30% by weight relative to resin-solids.

A sintered ferrite powder F-300 (average particle size of 50 μm, bulk density of 2.53 g/cm³, made by Powder Tech K. K.) was used as a core. The above obtained solution for coating was applied to the core by Spira-Coater (made by Okada Seiko K. K.) in such a way that the coating resin was applied to the core at 1.5% by weight relative to the core weight, followed by drying.

The resultant carrier was sintered for one hour at 160° C. in hot-air circulating oven. After cooling, the resultant ferrite bulk was pulverized by a screening apparatus equipped with a screen mesh having an opening between 106 μm and 75 μm. Thus, Resin-Coated Carrier (11) was obtained.

SYNTHESIS EXAMPLE A10 OF RESIN

MEK of 100 parts was put in a 500-ml flask equipped with a stirrer, a condenser, a thermometer, a nitrogen-inlet pipe, a dropping funnel. MEK in the flask was kept at 80° C.

Separately, 33.0 parts of MA, 13.7 parts of St, 5.1 parts of HEMA, 58.2 parts of MPTS, 1 part of V-40 are dissolved in 100 parts of MEK. The resultant solution was dropped into the flask kept at 80° C. for 2 hours to be matured for 2 hours.

SYNTHESIS EXAMPLES A11–A13 RESIN

Synthesis was carried out in a manner similar to Synthesis Example A10 of Resin, except that MA, St, HEMA and MPTS (organopolysiloxane 1) were used at an amount shown in Table 3 below:

TABLE 3

| Synthesis Example | MMA (parts) | HEMA (parts) | St (parts) | MPTS (parts) |
|---|---|---|---|---|
| A10 | 33.0 | 5.1 | 3.7 | 58.2 |
| A11 | 29.3 | 5.1 | 7.4 | 58.2 |
| A12 | 29.0 | 5.1 | 19.4 | 46.5 |
| A13 | 30.0 | 5.1 | 30.0 | 34.9 |

SYNTHESIS EXAMPLE A14 OF RESIN

Synthesis was carried out in a manner similar to Synthesis Example A10 of Resin, except that Organopolysiloxane-3 was used instead of MPTS (Organopolysiloxane-1).

SYNTHESIS EXAMPLE A15 OF RESIN

Synthesis was carried out in a manner similar to Synthesis Example A10 of Resin, except that Organopolysiloxane-3 was used instead of MPTS (Organopolysiloxane-1).

EXAMPLE A12

The resin prepared in Synthesis Example A10 of Resin was mixed with isophorone-diisocyanate/trimethylol-propane adduct (IPDI/TMP:NCO%=6.1%) as a cross-linking agent in such a way that the molar ratio of OH/NCO (OH is the one in the resin prepared in Synthesis Example 10) was 1/1. The mixture was diluted with MEK to give a resin solution for coating having a solid ratio of 3% by weight.

A sintered ferrite powder F-300 (average particle size of 50 μm, bulk density of 2.53 g/cm$^3$, made by Powder Tech K. K.) was used as a core. The solution for coating was applied to the core by Spira-Coater (made by Okada Seiko K. K.) in such a way that the coating resin was applied to the core at 1.5% by weight relative to the core weight, followed by drying.

The resultant carrier was sintered for one hour at 160° C. in hot-air circulating oven. After cooling, the resultant ferrite bulk was pulverized by a screening apparatus equipped with a screen mesh having an opening between 106 μm and 75 μm. Thus, Resin-Coated Carrier (12) was obtained.

EXAMPLES A13–A17

Resin-Coated Carriers (A13)–(A17) were prepared in a manner similar to Example A12, except that resins prepared in Synthesis Examples, core materials, resin-coating materials were used as shown in the following Table 4. The same cross-linking agent as in Example A12 was used.

COMPARATIVE EXAMPLE A1

Acrylic resin BR-80 (made by Mitsubishi Reiyon K. K.) was diluted with MEK to give a resin solution for coating having a solid content of 3% by weight.

A sintered ferrite powder F-300 (average particle size of 50 μm, bulk density of 2.53 g/cm$^3$, made by Powder Tech K. K.) was used as a core. The solution for coating was applied to the core by Spira-Coater (made by Okada Seiko K. K.) in such a way that the coating resin was applied to the core at 1.5% by weight relative to the core weight, followed by drying.

The resultant carrier was classified with a screening mesh having an opening of 75 μm. Thus, Resin-Coated Carrier (A18) was obtained.

COMPARATIVE EXAMPLE A2

Resin-Coated Carrier (A19) was prepared in a manner similar to Example A1, except that a styrene-acrylic copolymer resin synthesized with styrene, methyl methacrylate, 2-hydroxyethyl acrylate and methacrylic acid (1.5:7.0:1.0:0.5) instead of the resin prepared in Synthetic Example A1.

COMPARATIVE EXAMPLE A3

The resin prepared in Synthetic Example A7 was diluted with MEK to give a resin solution for coating having a solid content of 3% by weight.

A sintered ferrite powder F-300 (average particle size of 50 μm, bulk density of 2.53 g/cm$^3$, made by Powder Tech K. K.) was used as a core. The solution for coating was applied to the core by Spira-Coater (made by Okada Seiko K. K.) in such a way that the coating resin was applied to the core at 1.5% by weight relative to the core weight, followed by drying.

The resultant carrier was classified with a screening mesh having an opening of 75 μm. Thus, Resin-Coated Carrier (A20) was obtained.

The reins, cores, physical properties and coating amount used in Examples A12–A17 and Comparative Examples A1–A3 are summarized in the following Table 4.

TABLE 4

| | Resin prepared in Synthesis Example | Core | | | | Coating Resin Amount (wt. %) |
|---|---|---|---|---|---|---|
| | | Made by | Material | Volume Average Particle Size (μm) | Bulk density (g/cm$^3$) | |
| Example | | | | | | |
| A12 | Synthesis Example A10 | F-300 (Powder Tech K.K.) | Ferrite | 50 | 2.53 | 1.5 |
| A13 | Synthesis Example A11 | F-300 (Powder Tech K.K.) | Ferrite | 50 | 2.53 | 1.5 |
| A14 | Synthesis Example A12 | F-300 (Powder Tech K.K.) | Ferrite | 50 | 2.53 | 1.0 |
| A15 | Synthesis Example A13 | F-300 (Powder Tech K.K.) | Ferrite | 50 | 2.53 | 1.5 |
| A16 | Synthesis Example A14 | F-300 (Powder Tech K.K.) | Ferrite | 50 | 2.53 | 1.5 |
| A17 | Synthesis Example A15 | F-300 (Powder Tech K.K.) | Ferrite | 50 | 2.53 | 1.5 |
| Comparative Example | | | | | | |
| A1 | Acrylic Resin | F-300 (Powder Tech K.K.) | Ferrite | 50 | 2.53 | 1.5 |
| A2 | Acrylic Resin | F-400 (Powder Tech K.K.) | Ferrite | 50 | 2.53 | 1.5 |
| A3 | Synthesis Example A7 | F-300 (Powder Tech K.K.) | Ferrite | 50 | 2.53 | 1.5 |

EVALUATION OF CARRIER

Six parts of Toner A or Toner B was mixed respectively with 94 parts by weight of each carrier prepared in Examples A1–A17 and Comparative Examples A1–A3 to give a developer.

The developer was evaluated by use of CF-80 (made by Minolta K. K.) under conditions of temperature of 25° C.

and humidity of 55%. The copying process was repeated 20.000 times to evaluate durability with respect to copying. The results are summarized in the following Table 5 and Table 6.

TABLE 5

| | Carrier | | | | | | | | | Durability Regarding Copy under 25° C. and 55% | | | | | |
|---|---|---|---|---|---|---|---|---|---|---|---|---|---|---|---|
| | | Coating-resin Composition | | | | | | | Environ-mental | Initial | | | After 20,000 Times of Copy | | |
| | | Amount of Silicone Component | Amount of Cross-linking | | Charging Amount [μC/g] | | | | Resistance Image | Charging Amount | | | Charging Amount | | |
| | No. | (wt. %)* | Agent (wt. %) | Toner | $Q_{L/L}$ | $Q_{N/N}$ | $Q_{H/H}$ | ΔQ | Quality | [μC/g] | Fogs | Texture | [μC/g] | Fogs | Texture |
| Example A1 | A1 | 60 | 7 | A | −20.0 | −18.5 | −17.5 | ○ | ○ | −18.5 | ○ | ○ | −12.7 | ○ | ○ |
| Example A2 | A2 | 60 | 14 | A | −21.0 | −20.5 | −18.5 | ○ | ○ | −20.5 | ○ | ○ | −13.5 | ○ | ○ |
| Example A3 | A3 | 50 | 7 | A | −31.6 | −25.3 | −20.0 | ○ | ○ | −25.3 | ○ | ○ | −15.1 | ○ | ○ |
| Example A4 | A4 | 50 | 14 | A | −29.9 | −26.5 | −19.5 | ○ | ○ | −26.5 | ○ | ○ | −16.2 | ○ | ○ |
| Example A5 | A5 | 40 | 14 | B | −30.0 | −22.7 | −15.1 | ○ | ○ | −22.7 | ○ | ○ | −10.5 | Δ | ○ |
| Example A6 | A6 | 30 | 14 | B | −31.8 | −24.1 | −15.5 | Δ | ○ | −24.1 | ○ | ○ | −11.0 | Δ | ○ |
| Example A7 | A7 | 50 | 14 | A | −30.6 | −27.5 | −23.3 | ○ | ○ | −27.5 | ○ | ○ | −17.0 | ○ | ○ |
| Example A8 | A8 | 50 | 14 | A | −28.5 | −27.4 | −27.2 | ○ | ○ | −27.4 | ○ | ○ | −15.5 | ○ | ○ |
| Example A9 | A9 | 60 | 7 | A | −20.1 | −18.6 | −17.9 | ○ | ○ | −18.6 | ○ | ○ | −12.8 | ○ | ○ |
| Example A10 | A10 | 60 | 7 | A | −19.9 | −18.3 | −17.7 | ○ | ○ | −18.3 | ○ | ○ | −13.0 | ○ | ○ |
| Example A11 | A11 | 60 | 7 | A | −21.3 | −19.2 | −17.1 | ○ | ○ | −19.2 | ○ | ○ | −14.1 | ○ | ○ |

*solid ratio of organopolysiloxane

TABLE 6

| | Carrier | | | | | | | | | Durability Regarding Copy under 25° C. and 55% | | | | | |
|---|---|---|---|---|---|---|---|---|---|---|---|---|---|---|---|
| | | Coating-resin Composition | | | | | | | Environ-mental | Initial | | | After 20,000 Times of Copy | | |
| | | Amount of Silicone Component | Amount of Cross-linking | | Charging Amount [μC/g] | | | | Resistance Image | Charging Amount | | | Charging Amount | | |
| | No. | (wt. %)* | Agent (wt. %) | Toner | $Q_{L/L}$ | $Q_{N/N}$ | $Q_{H/H}$ | ΔQ | Quality | [μC/g] | Fogs | Texture | [μC/g] | Fogs | Texture |
| Example A12 | A12 | 50 | 14 | A | −27.2 | −24.6 | −17.5 | ○ | ○ | −24.6 | ○ | ○ | −14.1 | ○ | ○ |
| Example A13 | A13 | 50 | 14 | A | −26.0 | −22.7 | −15.5 | ○ | ○ | −22.7 | ○ | ○ | −12.5 | ○ | ○ |
| Example A14 | A14 | 40 | 14 | A | −28.5 | −21.0 | −14.1 | Δ | ○ | −21.0 | ○ | ○ | −10.0 | Δ | ○ |
| Example A15 | A15 | 30 | 14 | A | −30.3 | −22.6 | −14.5 | Δ | ○ | −22.6 | ○ | ○ | −10.5 | Δ | ○ |
| Example A16 | A16 | 50 | 14 | A | −28.5 | −25.2 | −21.3 | ○ | ○ | −25.2 | ○ | ○ | −15.1 | ○ | ○ |
| Example A17 | A17 | 50 | 14 | A | −27.1 | −25.4 | −24.5 | ○ | ○ | −25.4 | ○ | ○ | −13.2 | ○ | ○ |
| Comparative Example A1 | A18 | — | — | A | −16.8 | −9.7 | −4.9 | X | X | −9.7 | X | Δ | −3.2 | X | X |
| Comparative Example A2 | A19 | — | 18 | A | −40.3 | −28.5 | −16.3 | X | Δ | −28.5 | ○ | ○ | −7.2 | X | X |

TABLE 6-continued

| | Carrier | | | | | | | | | Durability Regarding Copy under 25° C. and 55% | | | | | |
|---|---|---|---|---|---|---|---|---|---|---|---|---|---|---|---|
| | | Coating-resin Composition | | | | | | | Environmental Resistance | Initial | | | After 20,000 Times of Copy | | |
| | No. | Amount of Silicone Component (wt. %)* | Amount of Cross-linking Agent (wt. %) | Toner | Charging Amount [μC/g] $Q_{L/L}$ | $Q_{N/N}$ | $Q_{H/H}$ | ΔQ | Image Quality | Charging Amount [μC/g] | Fogs | Texture | Charging Amount [μC/g] | Fogs | Texture |
| Comparative Example A3 | A20 | 50 | 0 | A | −29.1 | −21.5 | −15.3 | ○ | ○ | −21.5 | ○ | ○ | −9.3 | X | Δ |

*solid ratio of organopolysiloxane

CHARGING AMOUNT

Charging amount was measured by a film measuring method (toner content of 6% by weight).

QLL(μC/g): charge amount after developer was kept for 24 hours under conditions of temperature of 10° C. and humidity of 15%.

QNN(μC/g): charge amount after developer was kept for 24 hours under conditions of temperature of 25° C. and humidity of 55%.

QHH(μC/g): charge amount after developer was kept for 24 hours under conditions of temperature of 30° C. and humidity of 85%.

ENVIRONMENTAL RESISTANCE

Change of charging amount influenced by environments was evaluated to be ranked as follows;

o:ΔQ≦15 μC/g, QHH≧15 μC/g and QLL≦35 μC/g

Δ:15 μC/g<ΔQ≦20 μC/g, QHH≧10 μC/g and QLL≦40 μC/g, x: ΔQ>20 μC/g, QHH<10 μC/g or QLL>40 μC/g, in which ΔQ=|QLL-QHH|.

Further, copy images were formed under each environments by use of the copying machine to evaluate image quality. The evaluation was ranked. The rank of 'Δ' or higher is sufficient for practical use. The rank of 'o' is more preferable.

FOGS ON COPY IMAGES

Copy images were formed in combination of toner and carrier as above mentioned by use of the copying machine. The fogs on the copy images were evaluated with respect to toner fogs formed on white ground. The evaluation was ranked. The rank of 'Δ' or higher is sufficient for practical use. The rank of 'o' is more preferable.

TEXTURE OF COPY IMAGES

Texture was evaluated with respect to the one of images having half image-density. The evaluation was ranked. The rank of 'Δ' or higher is sufficient for practical use. The rank of 'o' is more preferable.

Examples using no cross-linking agent are explained hereinafter.

SYNTHESIS EXAMPLE B1

MEK of 100 parts was put in a 500-ml flask equipped with a stirrer, a condenser, a thermometer, a nitrogen-inlet pipe, a dropping funnel. MEK in the flask was kept at 80° C.

Separately, 50.0 parts of MA, 50.0 parts of MPTS, 1 part of V-40 are dissolved in 100 parts of MEK. The resultant solution was dropped into the flask kept at 80° C. for 2 hours for co-polymerization. Then, the solution was matured for 5 hours.

SYNTHESIS EXAMPLE B2

MEK of 100 parts was put in a 500-ml flask equipped with a stirrer, a condenser, a thermometer, a nitrogen-inlet pipe, a dropping funnel. MEK in the flask was kept at 80° C.

Separately, 40.0 parts of MA, 60.0 parts of MPTS, 1 part of V-40 are dissolved in 100 parts of MEK. The resultant solution was dropped into the flask kept at 80° C. for 2 hours for copolymerization. Then, the solution was matured for 5 hours.

SYNTHESIS EXAMPLE 3

A resin for coating was prepared in a manner similar to Synthesis Example B1, except that 25.0 parts of MA and 25.0 parts of styrene instead of 50.0 parts of styrene.

PRODUCTION OF TONER

Toner was prepared as follows in order to evaluate the coated carrier prepared in Synthesis Example B1–B3 .

Thermoplastic resin styrene-acrylic resin of 100 parts (Mn:4,500, Mw: 197,800, Tg: 60.5° C., softening point:121° C., acid value:24.3), carbon black of 8 parts (MA#8 (made by Mitsubishi Kasei Kogyo K. K.)), off-set prevention agent of 4 parts (Viscol 660P (low molecular weight polypropylene, made by Sanyo Kasei Kogyo K. K.), and bontron S-34 of 3 parts (Cr-containing dye soluble in oil, made by Oriento Kagaku K. K.).

The above ingredients were put in a 10-liter Henshe l Mixer and mixed for 2 minutes at 2,000 rpm. The mixture was kneaded and extruded continuously by Extruder PCM30 (L/d:32.5). After cooling, the kneaded material was pulverized coarsely by a feather mill having 2 mm mesh-opening and further pulverized finely. The pulverized material was classified by a classifier to remove fine particles and coarse particles. Thus, particles having 11.2 μm in mean particle size were obtained.

The resultant particles of 100 parts were mixed with hydrophobic silica of 0.2 parts (H-2000; made by Nippon Hext K. K.) by Henshel Mixer to give a toner.

EXAMPLE B1

The resin obtained in Synthesis Example B1 was diluted with MEK to give a resin solution for coating having a solid content of 3% by weight.

A sintered ferrite powder F-300 (average particle size of 50 μm, bulk density of 2.53 g/cm$^3$, made by Powder Tech K. K.) was used as a core. The solution for coating was applied to the core by Spira-Coater (made by Okada Seiko K. K.) in such a way that the coating resin was applied to the core at 1.5% by weight relative to the core weight, followed by drying.

The resultant carrier was classified with a screening mesh having an opening of 75 μm. Thus, Resin-Coated Carrier (B1) was obtained.

EXAMPLE B2

Resin-Coated Carrier (B2) was prepared in a manner similar to Example B1, except that the coating resin synthesized in Synthesis Example B2 was used.

EXAMPLE B3

Resin-Coated Carrier (B3) was prepared in a manner similar to Example B1, except that the coating resin synthesized in Synthesis Example B3 was used.

COMPARATIVE EXAMPLE B1

Resin-Coated Carrier (B4) was prepared in a manner similar to Example B1, except that Acrylic resin BR-83 (made by Mitsubishi Leiyon was used as a coating resin.

EVALUATION

The toner plepared above (5 parts) was mixed with each carrier prepared in Examples B1, B2, B3 and Comparative Examples (95 parts) to give a developer. The copying process was repeated 20,000 times under the conditions of temperature of 25° C. and humidity of 55% by use of Copying Machine D30 (made by Minolta K. K.) to evaluate the durability of the developer with respect to copy. The following items with respect to the durability were evaluated. The results were shown in Table 7. Further, environmental changes of charging amount and environmental resistance of the carrier itself were evaluated. The results were also shown in Table 7.

FOGS ON COPY IMAGES

Copy images were formed in combination of toner and carrier as above mentioned by use of the copying machine. The fogs on the copy images were evaluated with respect to toner fogs formed on white ground. The evaluation was ranked. The rank of 'Δ' or higher is sufficient for practical use. The rank of 'o' is more preferable.

TEXTURE OF COPY IMAGES

Texture was evaluated with respect to the one of images having half image-density. The evaluation was ranked. The rank of 'Δ' or higher is sufficient for practical use. The rank of 'o' is more preferable.

ENVIRONMENTAL CHANGE OF CHARGING AMOUNT

The following charging amounts were measured.

QLL(μC/g): charge amount after developer was kept for 24 hours under conditions of temperature of 10° C. and humidity of 15%.

QNN(μC/g): charge amount after developer was kept for 24 hours under conditions of temperature of 25° C. and humidity of 55%.

QHH(μC/g): charge amount after developer was kept for 24 hours under conditions of temperature of 30° C. and humidity of 85%.

ENVIRONMENTAL RESISTANCE

Change of charging amount influenced by environments was evaluated to be ranked as follows;

o: $\Delta Q \leqq 10$ μC/g, QHH$\geqq$15 μC/g and QLL$\leqq$35 μC/g

Δ: $\Delta Q \leqq 15$ μC/g, QHH$\geqq$10 μC/g and QLL$\leqq$40 μC/g, x: $\Delta Q > 15$ μC/g, QHH<10 μC/g or QLL>40 μC/g, in which $\Delta Q = |QLL - QHH|$.

Copy images were formed under each environments by use of the copying machine to evaluate image quality. The evaluation was ranked. The rank of 'Δ' or higher is sufficient for practical use. The rank of 'o' is more preferable.

What is claimed is:

1. A carrier comprising: a magnetic core; and a coating layer formed on the surface of the core, said coating layer comprising an isocyanated resin produced by the reaction of an isocyanate compound and a copolymer of an organopolysiloxane and a radical polymerizable monomer, said organopolysiloxane having a vinyl group, and said radical polymerizable monomer having at least one group selected from

TABLE 7

| | | | | | | Durability Regarding Copy under 25° C. and 55% | | | | | |
|---|---|---|---|---|---|---|---|---|---|---|---|
| | | | | | | Initial | | | After 20,000 Times of Copy | | |
| | Carrier | Charging Amount [μC/g] | | | Environmental | Charging Amount | | | Charging Amount | | |
| | No. | L/L | N/N | H/N | Resistance | [μC/g] | Fogs | Texture | [μC/g] | Fogs | Texture |
| Example B1 | B1 | −23.9 | −20.7 | −18.1 | ○ | −20.7 | ○ | ○ | −14.5 | ○ | ○ |
| Example B2 | B2 | −21.0 | −18.2 | −16.9 | ○ | −18.2 | ○ | ○ | −11.4 | ○ | ○ |
| Example B3 | B3 | −20.0 | −17.2 | −15.2 | ○ | −17.2 | ○ | ○ | −14.0 | ○ | ○ |
| Comparative Example B1 | B4 | −22.8 | −17.1 | −10.2 | Δ | −17.1 | ○ | ○ | −3.5 | X | X |

CHARGING AMOUNT

Charging amount was measured by a film measuring method (toner content of 6% by weight).

the group consisting of a hydroxy group, an amino group, an amido group and an imido group.

2. The carrier of claim 1 wherein an amount of the organopolysiloxane is from 5% by weight to 80% by weight with respect to the total amount of the copolymer.

3. The carrier of claim 1 wherein an amount of the coating layer is from 0.3% by weight to 5% by weight with respect to the magnetic core.

4. The carrier of claim 1 wherein the radical polymerizable monomer is an acrylate monomer having a hydroxy group or a methacrylate monomer having a hydroxy group.

5. The carrier of claim 1 wherein the copolymer comprises a second radical polymerizable monomer which is copolymerizable with the or organopolysiloxane.

6. The carrier of claim 5 wherein the second radical polymerizable monomer is selected from the group consisting of an acrylate monomer, a methacrylate monomer and a styrene monomer.

7. The carrier of claim 5 wherein the second radical polymerizable monomer is styrene monomer and at least one monomer selected from the group consisting of an acrylate monomer and a methacrylate monomer.

8. The carrier of claim 1 wherein the isocyanate compound is selected from the group consisting of diisocyanates and polyisocyanates, the diisocynates being selected from the group consisting of hexamethylenediisocyanate, isophoronediisocyanate, tolylenediisocyanate, diphenylmethaneisocyanate and xylenediisocyanate and the polyisocyanates being selected from the group consisting of the following chemical formulas (AV)–(AIX) having 3–6 functional groups:

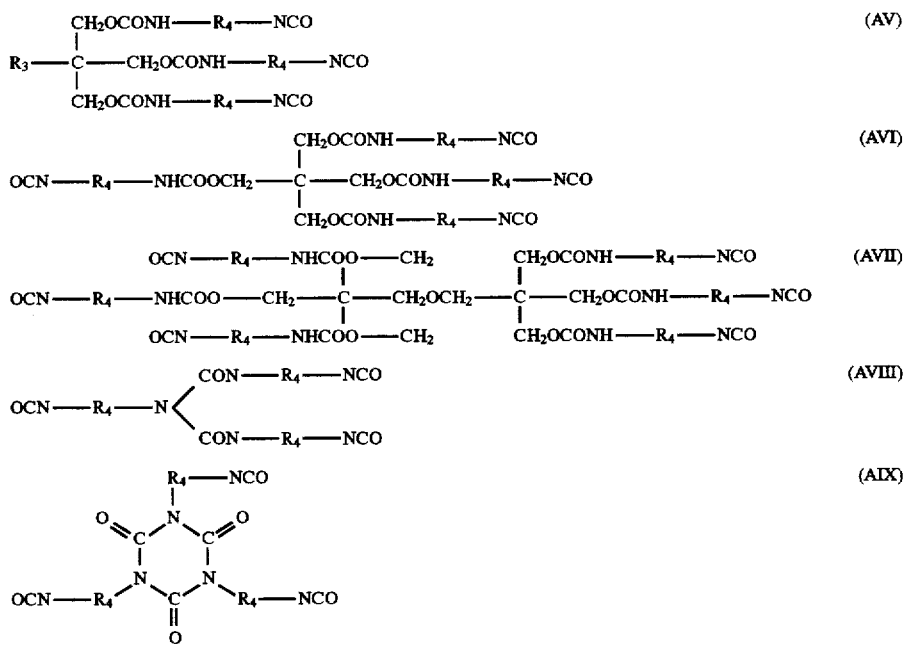

(AV)

(AVI)

(AVII)

(AVIII)

(AIX)

in which $R_3$ is selected from the group consisting of a hydrogen atom, a methyl group and an ethyl group; $R_4$ is selected from the group consisting of $-(CH_2)_6-$,

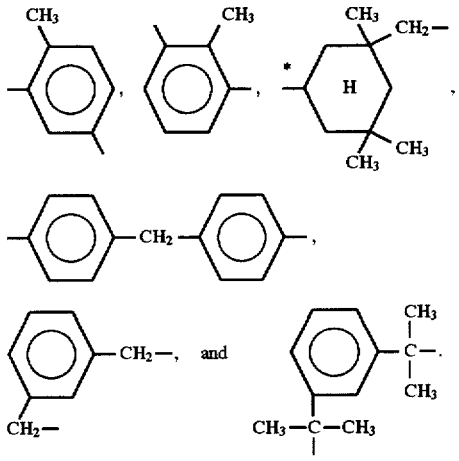

9. The carrier of claim 1 wherein the magnetic core is treated by a surface treating agent selected from the group consisting of silane coupling agents, titanate coupling agents, aluminum coupling agents and zirconium-aluminum coupling agents.

10. The carrier of claim 1 wherein the coating layer is treated by a surface treating agent selected from the group consisting of silane coupling agents, titanate coupling agents, aluminum coupling agents and zirconium-aluminum coupling agents.

11. The carrier of claim 1 wherein the coating layer further comprises electrical conductive particles dispersed therein.

12. The carrier of claim 11 wherein the electrical conductive particles have an electrical resistance within the range between $10^3$–$10^9$ Ω cm.

13. A carrier comprising:

a magnetic core; and a coating layer formed onto the surface of the core, said layer comprising a resin of copolymer of an organopolysiloxane having a chemical structure of the formula (BX) and a radical polymerizable monomer;

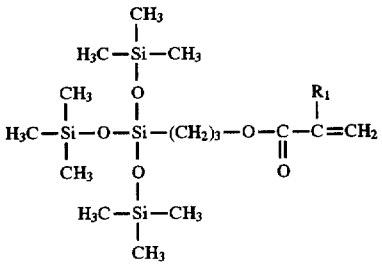

(BX)

wherein $R_1$ represents a hydrogen atom or a methyl group.

14. The carrier of claim 13 wherein the radical polymerizable monomer is selected from the group consisting of an acrylate monomer, a methacrylate monomer and a styrene monomer.

15. The carrier of claim 13 wherein an amount of the organopolysiloxane is from 5% by weight to 80% by weight with respect to the total amount of the copolymer.

16. The carrier of claim 13 wherein the magnetic core is treated by a surface treating agent selected from the group consisting of silane coupling agents, titanate coupling agents, aluminum coupling agents and zirconium-aluminum coupling agents.

17. The carrier of claim 13 wherein the coating layer is treated by a surface treating agent selected from the group consisting of silane coupling agents, titanate coupling agents, aluminum coupling agents and zirconium-aluminum coupling agents.

18. The carrier of claim 13 wherein the coating layer further comprises electrical conductive particles dispersed therein.

19. The carrier of claim 18 wherein the electrical conductive particles have an electrical resistance within the range between $10^3$–$10^9$ Ω cm.

20. A carrier comprising:

a magnetic core; and a coating layer formed onto the surface of the core, said layer comprising an isocyanated resin produced by the reaction of an isocyanate compound and a copolymer of an organopolysiloxane and a radical polymerizable monomer, said radical polymerizable monomer having at least one group selected from the group consisting of a hydroxy group, an amino group, an amido group and an imido group, and said organopolysiloxane having a chemical structure selected from the group consisting of the formulas (AI), (AII), (AIII) and (AIV);

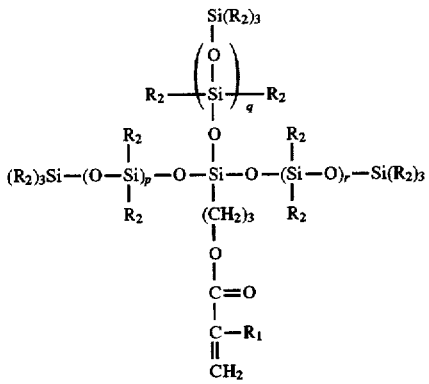

(AI)

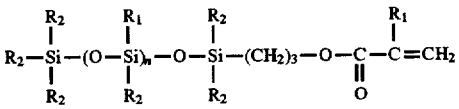

(AII)

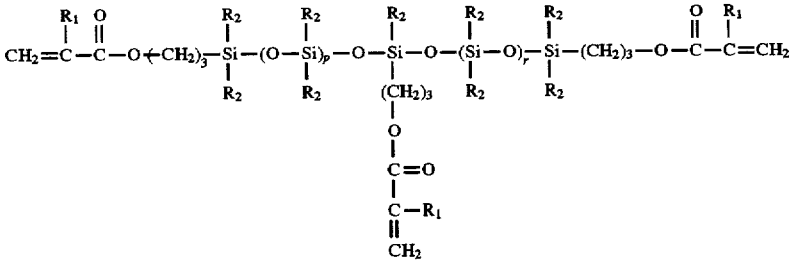

(AIII)

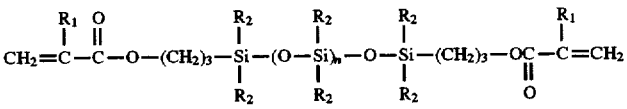

(AIV)

wherein $R_1$ represents a hydrogen atom or methyl group, $R_2$ represents an alkyl group having 1–3 carbon atoms or a phenyl group, p, q and r represent respectively an integer of zero or more, and n represents an integer of 2 or more.

21. The carrier of claim 20 wherein the formula (AI) satisfies the following relationship:

$0 \leqq p+q+r \leqq 500$.

22. The carrier of claim 20 wherein the formula (AI) satisfies the following relationship:

$0 \leqq p+q+r \leqq 64$.

23. The carrier of claim 20 wherein the formula (AII) satisfies the following relationship:

$2 \leqq n \leqq 500$.

24. The carrier of claim 20 wherein the formula (AII) satisfies the following relationship:

$2 \leqq n \leqq 64$.

25. The carrier of claim 20 wherein the formula (AIII) satisfies the following relationship:

$0 \leqq p+r \leqq 500$.

26. The carrier of claim 20 wherein the formula (AIII) satisfies the following relationship:

$0 \leqq p+r \leqq 64$.

27. The carrier of claim 20 wherein the formula (AIV) satisfies the following relationship:

$2 \leqq n \leqq 500$.

28. The carrier of claim 20 wherein the formula (AIV) satisfies the following relationship:

$2 \leqq n \leqq 64$.

29. The carrier of claim 20 wherein the copolymer comprises a second radical polymerizable monomer which is copolymerizable with the organopolysiloxane.

* * * * *

UNITED STATES PATENT AND TRADEMARK OFFICE

CERTIFICATE OF CORRECTION

PATENT NO. : 5,731,120

DATED : March 24, 1998

INVENTOR(S) : Tanigami et al.

It is certified that error appears in the above-identified patent and that said Letters Patent is hereby corrected as shown below:

In the claims:

Claim 5, line 3, delete "or".

Claim 8, column 26, the first formula, delete "*".

Claim 20, in (AII) formula, 2nd bond, change "$R^1$" to --$R^2$--;

in (AIV) formula, change "OC" to --O-C--; and line 63, change "alky!" to --alkyl--.

Signed and Sealed this

Twenty-fifth Day of April, 2000

*Attest:*

Q. TODD DICKINSON

*Attesting Officer*

*Director of Patents and Trademarks*